United States Patent [19]

Mochida et al.

[11] Patent Number: 4,603,563

[45] Date of Patent: Aug. 5, 1986

[54] MAGNETIC DOOR LOCKING SYSTEM

[75] Inventors: Haruo Mochida, Kanagawa; Keiichi Shimizu; Shigetami Okuya, both of Tokyo, all of Japan

[73] Assignees: Nissan Motor Co., Ltd.; Kokusan Kinzoku Kogyo Kabushiki Kaisha, both of Japan

[21] Appl. No.: 519,902

[22] Filed: Aug. 3, 1983

[30] Foreign Application Priority Data

Aug. 10, 1982 [JP] Japan ..... 57-137841
Aug. 10, 1982 [JP] Japan ..... 57-137842

[51] Int. Cl.[4] ..... E05B 47/00

[52] U.S. Cl. ..... 70/276; 70/408; 70/413

[58] Field of Search ..... 70/276, 413, 408; 292/251.5

[56] References Cited

U.S. PATENT DOCUMENTS

| | | | |
|---|---|---|---|
| 3,653,237 | 4/1972 | DuRocher . | |
| 3,786,659 | 1/1974 | Elder et al. | 70/408 X |
| 3,897,092 | 7/1975 | Atkins | 292/336.3 X |
| 4,252,351 | 2/1981 | Yoshimo et al. . | |
| 4,287,735 | 9/1981 | Brunken et al. | 70/408 X |
| 4,380,162 | 4/1983 | Woolfson | 70/413 X |

FOREIGN PATENT DOCUMENTS

| | | | |
|---|---|---|---|
| 0085296 | 8/1983 | European Pat. Off. . | |
| 3005890 | 9/1980 | Fed. Rep. of Germany . | |
| 2436235 | 5/1980 | France | 70/276 |
| 638959 | 4/1962 | Italy | 70/276 |
| D378792 | 10/1982 | Japan | 70/276 |
| 577686 | 5/1946 | United Kingdom | 70/408 |
| 1528569 | 10/1978 | United Kingdom . | |
| 1572091 | 7/1980 | United Kingdom | 70/413 |

*Primary Examiner*—Robert L. Wolfe
*Assistant Examiner*—Lloyd A. Gall
*Attorney, Agent, or Firm*—Leydig, Voit & Mayer, Ltd.

[57] ABSTRACT

In a magnetic locking system for locking a door to a fixed member, comprising a key cylinder connected to the door, a magnetic sensor connected to the door near the key and operating when sensing a predetermined magnetic force, control means for locking the door to the fixed member when the magnetic sensor operates, and a magnet-mounted key including a key cylinder proper which is to be engaged with the key cylinder and a key head which is equipped with an elongate magnet piece, there is proposed an arrangement in which when the key is operatively engaged with the key cylinder to turn same, an imaginary plane which the axis of the magnet piece describes when the key turns about the axis of the key cylinder intersects the axis of the magnetic sensor.

14 Claims, 11 Drawing Figures

MAGNETIC DOOR LOCKING SYSTEM

BACKGROUND OF THE INVENTION (1) Field of the Invention

The present invention relates in general to a door locking system of a motor vehicle, and more particularly to a so-called "magnetic door locking system" which can lock the door from outside by only bringing a magnet piece close to a magnetic sensor mounted in the door.

(2) Description of the Prior Art

Nowadays, in order to facilitate door locking from outside, a magnetic door locking system has been proposed in a motor vehicle, which comprises generally a magnetic sensor mounted in the door, control means for locking the door when the sensor senses a predetermined magnitude of magnetic force applied thereto, and a magnet piece carried by the car owner (or driver). Upon requirement of door locking from outside, he or she brings the magnet piece close to a given portion of the door where the sensor is positioned. With this handling, the sensor actuates the control means to lock the door.

In the system mentioned as above, for improved portability of the magnet piece and easier handling of the same, it has been also proposed that the magnet piece is combined with a door locking key (that is, an ignition key) which is engageable with a door-mounted key cylinder to lock or unlock the door and the magnetic sensor is conveniently positioned in the vicinity of the key cylinder. However, in this close or convenient arrangement, it sometimes happens that the door unlocking operation by the key from outside would induce re-locking of the door because of the magnet piece which issues magnetism to the near-positioned magnetic sensor. This is quite inconvenient when opening of the door is actually required. This drawback will be described in detail hereinafter.

SUMMARY OF THE INVENTION

It is therefore an essential object of the present invention to provide an improved magnetic door locking system which is free of the aforementioned drawback.

According to the present invention, there is provided a magnetic locking system for locking a door to a fixed member, which comprises a key cylinder connected to the door, a magnetic sensor connected to the door in the vicinity of the key cylinder, the sensor operating when a predetermined magnitude of magnetic force is applied thereto in a direction substantially parallel with a given axis of the sensor, control means for locking the door to the fixed member when the magnetic sensor operates, and a magnet-mounted key including a key proper which is to be engaged with the key cylinder to turn the same about its axis, and a key head which has a magnet fixed thereto, the magnet having at its axially opposed end portions N and S poles, respectively, wherein the positional relationship between the key cylinder, the sensor and the key is so made that when the key is operatively engaged with the key cylinder, an imaginary plane which the axis of the magnet piece describes when the key turns about the axis of the key cylinder intersects the given axis of the magnetic sensor.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
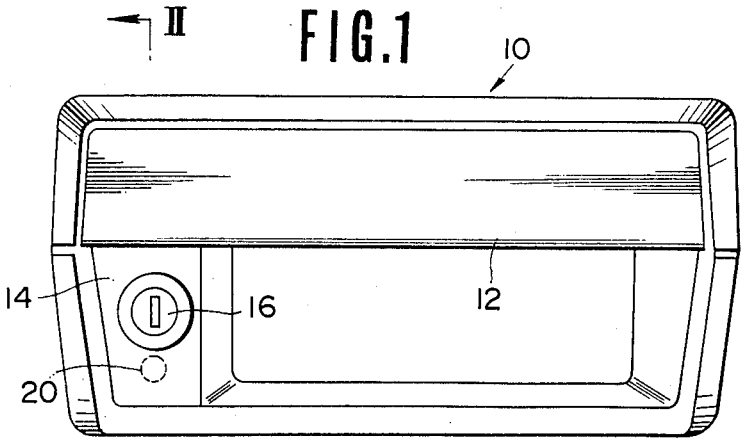
FIG. 1 is a front view of a door handle-equipped escutcheon to which a magnetic door locking device is mounted.
Figure 2:
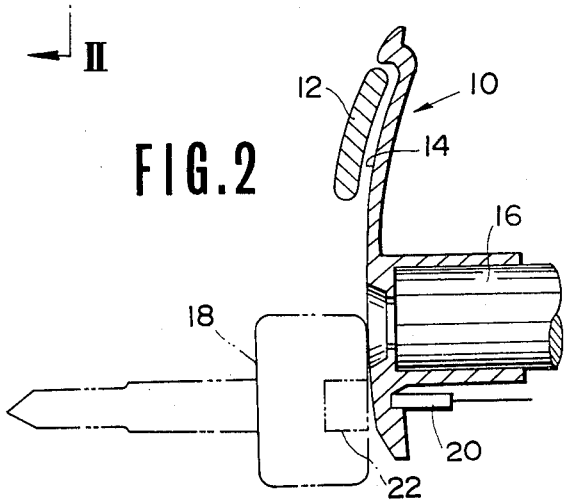
FIG. 2 is a sectional view taken along the line II—II of FIG. 1, with a key drawn by a phantom line.
Figure 3:
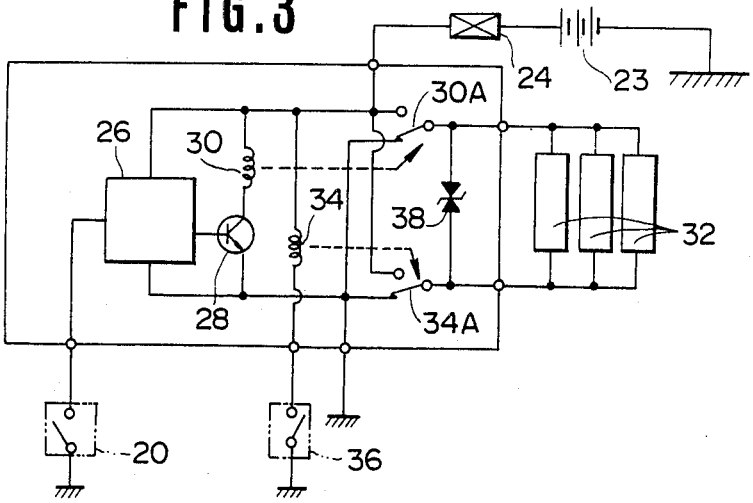
FIG. 3 is an electric circuit diagram employed in the magnetic door locking device of FIGS. 1 and 2.

Prior to describing the invention, a magnetic door locking system to which the present invention is applied will be outlined with reference to FIGS. 1 to 3 in order to clarify the invention.

Referring to FIGS. 1 and 2, there is shown an escutcheon 10 mounted to a door outer panel (not shown). The escutcheon 10 is made of, for example, plastics and is shaped to receive therein a door handle 12. The door handle 12 is linked to a conventional door latching mechanism (not shown) mounted in the door so that when the handle 12 is gripped by an operator's hand, the latching mechanism unlatches the door from the vehicle body proper. The escutcheon 10 is formed with an outwardly raised portion 14 to which a key cylinder 16 of a door locking mechanism (not shown) is mounted from inside as shown. Designated by numeral 18 (see FIG. 2) is a key which is associated with the key cylinder 16 to turn the same. A magnetic sensor 20 is mounted to the inboard side of the raised portion 14 near the key cylinder 16. The sensor 20 assumes its ON position when a predetermined magnitude of magnetic force is applied thereto. In the disclosed example, the key 18 is equipped with a magnet piece 22 so that when it is brought close to the sensor 20 in the illustrated manner, the sensor 20 becomes turned ON.

Referring to FIG. 3, there is shown an electric circuit diagram of a control means employed in the magnetic door locking system of this invention for operating the locking mechanism when the sensor operates in response to the application of a predetermined magnitude of magnetic force. In the circuit, a battery and a fuse are designated by numerals 23 and 24. Designated by numeral 26 is a timer which supplies a transistor 28 with a base current for a predetermined time when the magnetic sensor 20 assumes its ON position. The collector of the transistor 28 is connected to the battery 23 through a relay coil 30. Designated by numeral 32 are electric actuators which, when electrically energized by given current, actuate the associated respective locking mechanisms to assume their locking conditions. One of the actuators 32 is applied to the afore-mentioned door locking mechanism with which the key cylinder 16 is associated. Designated by numerals 34 and 36 are a relay coil and an unlocking switch which are connected in series with the battery 23. The unlocking switch 36 is linked to a door-mounted door locking knob (not shown) so that when the knob assumes its door locking position, the switch 36 opens. Designated by numerals 30A and 34A are relay switches which change their operative positions in response to energization and de-energization of their associated relay coils 30 and 34. In the illustrated example, the relay switches 30A and 34B are arranged to change the direction of the current applied to the actuators 32 from the battery 23. A zener diode 38 is arranged in parallel with the actuators 32.

For convenience in the following description the starting condition is when the door is latched and the electric circuit assumes the condition as shown in FIG. 3.

For locking the door from outside, the magnet-mounted key 18 is brought close to the magnetic sensor 20 mounted in the door. With this, the sensor 20 becomes turned ON causing the timer 26 to operate thereby supplying the transistor 28 with a base current for a predetermined time. Thus, the transistor 28 is turned ON causing current from the battery 23 to flow through the relay coil 30, and thus causing the relay switch 30A to be shifted to the battery side. With this, the actuators 32 are supplied with current to actuate the associated respective locking mechanisms to assume their locking conditions. Thus, when the key 18 is brought close to the magnetic sensor 20, the door becomes locked.

For unlocking the door from the outside, the key 18 is inserted into the key cylinder 16 to turn the same and the door becomes unlocked in a conventional manner. When unlocking of the door from the inside is required, the door locking knob (not shown) is turned to actuate and close the unlocking switch 36 to and close the relay coil 34 is supplied with current from the battery 23 thereby causing the relay switch 34A to be shifted to the battery side. Thus, the actuators 32 are suplied with the reversed current from the battery 23 thereby actuating the associated respective locking mechanisms to assume their unlocking conditions. Thus, the door becomes unlocked.

However, this type of magnetic door locking system may suffer from the following drawback originating from the inherent construction thereof, particularly, the combined construction of the magnet piece 22 and the key plate 18.

That is, during the door unlocking operation when inserting the key 18, it sometimes happens that the magnet piece 22 mounted in the key 18 induces operation of the magnetic sensor 20 after completion of the door unlocking by the key 18. This is quite disadvantageous because, for opening the door, the door unlocking operation by the key 18 must be repeated paying attention to the position of the magnet piece 22 in the key 18. (This drawback can be solved by separating the magnet piece 22 from the key plate 18. However, the separation of these parts may cause the undesirable possibility that the door is locked by the separate magnet piece from outside leaving the key inside the vehicle.)

Figure 4:
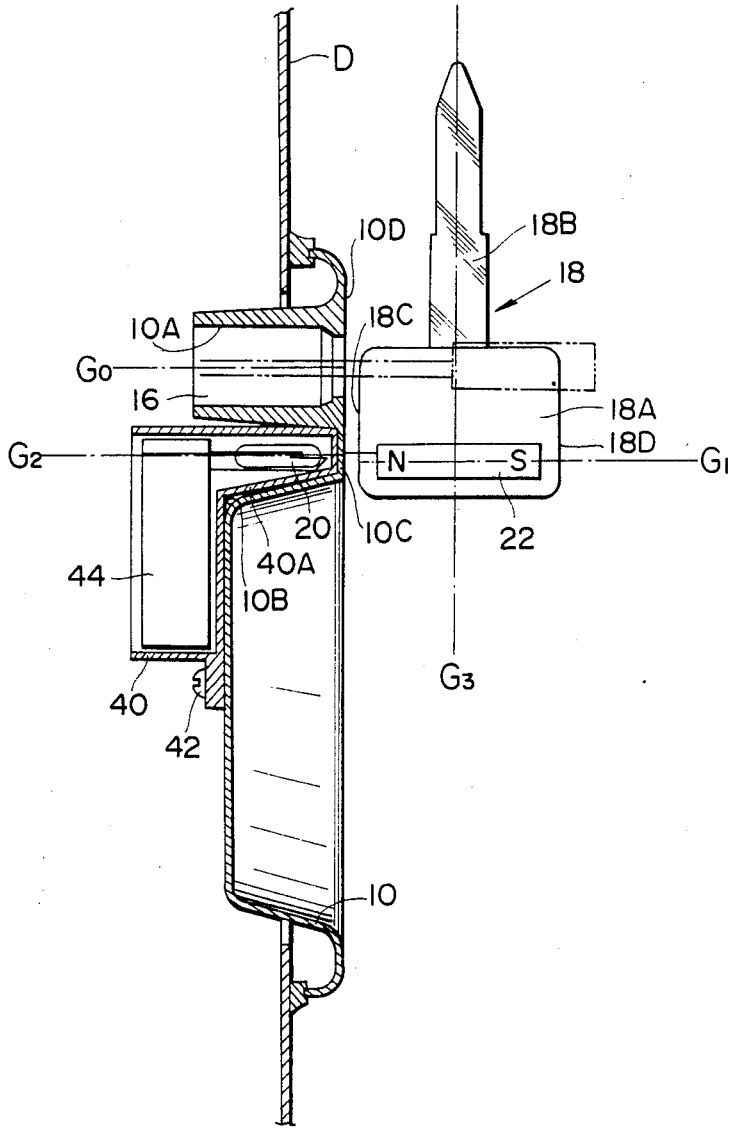
FIG. 4 is a sectional view similar to FIG. 2, but showing an embodiment of the present invention.

Referring to FIG. 4, there is shown an embodiment of the present invention which is free of the abovementioned drawback. In the drawing, corresponding parts to those of the afore-mentioned magnetic door locking system are designated by the same numerals.

Reference D denotes an outer panel of the vehicle door. An escutcheon 10 is mounted to the door outer panel D and is formed with a cylindrical bore 10A in which a key cylinder 16 is rotatably disposed. Reference $G_o$ denotes an axis about which the key cylinder 16 is rotatable. In the vicinity of the bore 10A, there is formed a depression 10B which extends parallel with the axis $G_o$ and terminates at a portion 10C of a front flat face 10D behind which the bore 10A is positioned. A case 40 having a generally L-shaped cross section is fixed by bolts 42 (only one is shown) to the escutcheon 10 from inside in such a manner that the projected section 40A is tightly received in the depression 10B. Within the major portion of the case 40 is disposed a control circuit means which corresponds to the essential part of the circuit of FIG. 3. A magnetic sensor 20 is tightly disposed in the projected section 40A in such a manner that the axis $G_2$ of the sensor is substantially perpendicular to the front flat face 10D, that is, in a manner that the sensor 20 is most sensitive to a magnetic force from a magnet extending along a polar axis which is substantially parallel with the sensor axis $G_2$, such as a magnet 22, which is held perpendicularly to the limited portion 10C on the outside of the door.

A key 18 for the key cylinder 16 is equipped at its head portion 18A with an elongate magnet piece 22. As is seen from the drawing, the magnet piece 22 is so arranged that the longitudinal axis $G_1$ (the axis passing through N and S poles) thereof is substantially perpendicular to the longitudinal axis $G_3$ of the shank portion 18B of the key 18.

Upon requirement of door locking, the key 18 is brought close to the limited portion 10C of the escutcheon 10. However, in this case, the actuation of the magnetic sensor 20 is achieved only when the key 18 assumes the illustrated position, a turn over position of the illustrated position, and a slightly shifted but permitted position. In other words, the magnetic sensor 20 is turned ON only when the magnet piece 22 in the key 18 is brought close to the sensor 20 with the axis $G_1$ thereof in parallel with the axis $G_2$ of the sensor 20. In practical use, contacting either side 18C or 18D to the limited portion 10C induces the operation of the sensor 20.

Upon requirement of unlocking the door from outside, the shank portion 18B of the key 18 is inserted into the key cylinder 16 to turn the same about the axis $G_o$ thereof. In this case, the axis $G_1$ of the magnet piece 22 in the key 18 extends, as herein shown, substantially perpendicularly to the axis $G_2$ of the magnetic sensor 20 as the key turns the key cylinder about its axis. It also is clear that, when the polar axis $G_1$ of the magnet piece 22 is perpendicular to the axis of the shank portion 18B, as shown, the polar axis $G_1$ of the magnet piece describes an imaginary plane intersecting the axis $G_2$ of the magnetic sensor 20 when the key is used to turn the key cylinder about its axis $G_o$. Thus, the sensor 20 is assuredly prevented from operation during the door unlocking handling by the key 18, unlike the case of the afore-mentioned one.

Figure 5:
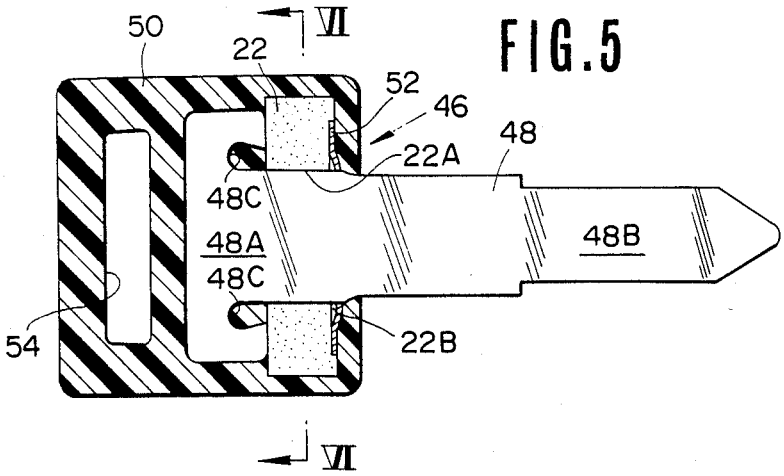
FIG. 5 is a sectional view of a key which is employable in the embodiment of FIG. 4.
Figure 6:
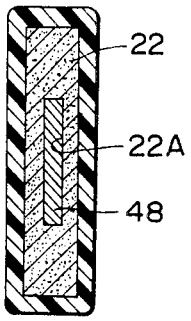
FIG. 6 is a sectional view taken along the line VI—VI of FIG. 5.
Figure 7:
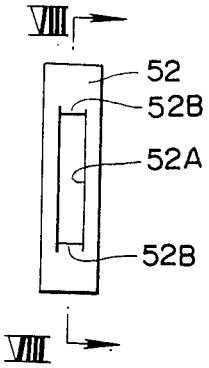
FIG. 7 is a front view of a stopper plate disposed in the key of FIGS. 5 and 6.
Figure 8:
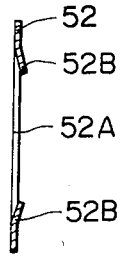
FIG. 8 is a sectional view taken along the line VIII—VIII of FIG. 7.

Referring to FIGS. 5 to 8, particularly FIG. 5, there is shown a magnet-mounted key 46 which is employable in the embodiment of the invention. As is best shown in FIG. 5, the key 46 comprises generally a key plate proper 48 made of metal, a rectangular key head 50 made of plastics, and an elongate magnet piece 22 disposed in the key head 50. The key plate proper 48 is of a generally T-shape having a shank portion 48B and a laterally extending head portion 48A. The head portion 48A is formed at its sides with recesses 48C for the purpose which will become apparent hereinafter. The magnet piece 22 is formed at its center portion with a rectangular opening 22A into which the shank portion 48B of the key plate proper 48 is snugly received with the head portion 48A engaging with the inboard side of the magnet piece 22, as shown. The magnet piece 22 is formed at its outboard side with a shallow recess 22B for receiving therein a stopper plate 52. As is shown in FIGS. 7 and 8, the stopper plate 52 has at its central portion a rectangular opening 52A into which the shank portion 48B of the key plate proper 48 is inserted. Pawls 52B are formed at the longitudinally opposed ends of the opening 52A, which are somewhat raised at their leading ends as is seen from FIG. 8. After putting the shank portion 48B through the rectangular opening 52A, the stopper plate 52 is put in the shallow recess 22B of the magnet 22 having the pawls 52B resiliently engaged with the shank portion 48B, so that the magnet 22 is tightly held on the shank portion keeping the contact with the head portion 48A of the key plate proper 48. The plastic key head 50 is molded on the key plate proper 48 so that upon completion of the moulding, the molding plastic covers the head portion 48A, the magnet 22 and the stopper plate 52, as is seen from FIG. 5. Of course, upon assembly, the magnet piece 22 is so arranged that the longitudinal axis thereof is substantially perpendicular to the longitudinal axis of the shank portion 48B of the key plate proper 48 for the reason as mentioned hereinafore. It is to be noted that the provision of the recesses 48C assures bonding of the key plate proper 48 to the plastic key head 50. The key head 50 is formed with a rectangular opening 54 through which a carrying band (not shown) passes.

Figure 9:
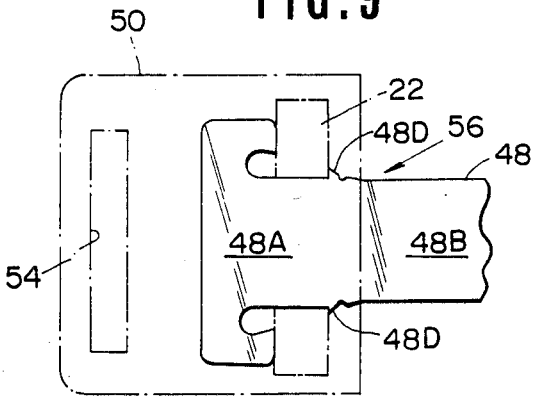
FIG. 9 is a partial sectional view of another key which is also employable in the embodiment of FIG. 4.

Referring to FIG. 9, there is shown another key 56 employable in the present invention. In this case, the fixing of the magnet piece 22 to the shank portion 48B of the key plate 48 is effected by bending projections 48D formed on both sides of the key plate proper 48.

Figure 10:
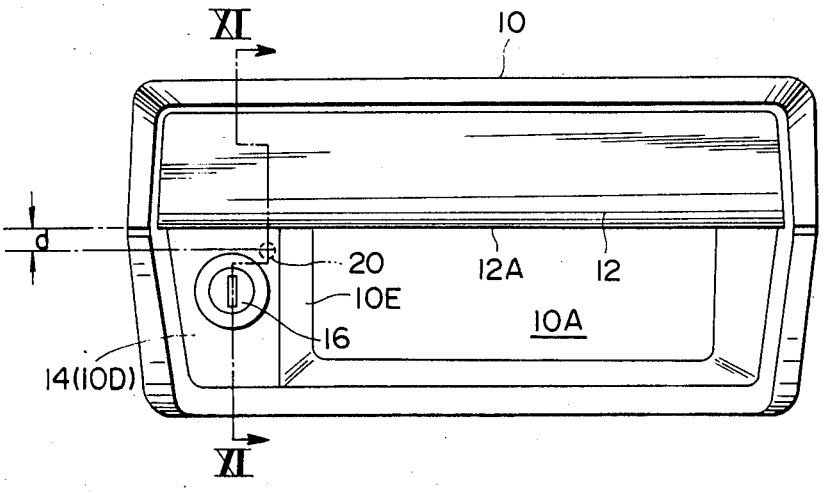
FIG. 10 is a view similar to FIG. 1, but showing the positional relationship between the door outside handle and essential parts of the magnetic door locking device.
Figure 11:
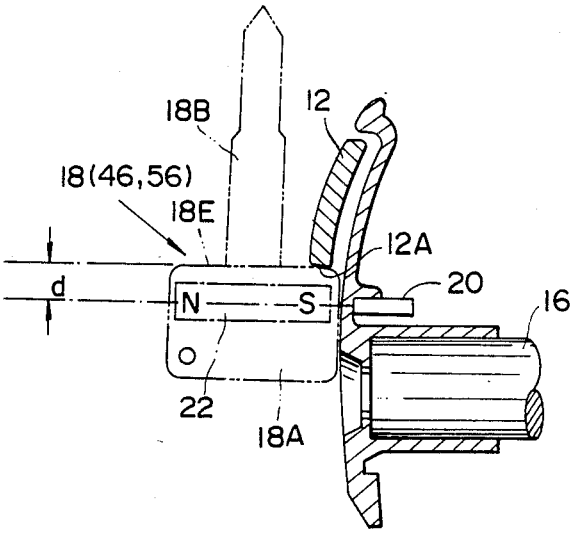
FIG. 11 is a sectional view taken along the line XI—XI of FIG. 10, with a key assuming a door locking position.

Referring to FIGS. 10 and 11, there is shown an improved arrangement of the magnetic door locking device which can serve easy handling of the key 18 when locking of the door from outside by using the magnet-mounted key 18 is required. Since the arrangement shown in these drawings is similar to the aforementioned arrangement of FIGS. 1 and 2, corresponding parts to those of FIGS. 1 and 2 are denoted by the same numerals and detailed explanation of them will be omitted from the following, except the part and portions which constitute the essential of the improvement.

The door handle 12 is operatively received in the escutcheon 10 mounted on the door (not shown). The door handle 12 shown in the drawings extends laterally over the depression 10A of the escutcheon 10 and the raised portion 14 of the same and has a straight lower edge 12A which is chamfered as is seen from FIG. 11. The key cylinder 16 is mounted to the raised portion 14 from inside, and the magnetic sensor 20 is mounted in the vicinity of the key cylinder 16 in such a manner that the longitudinal axis thereof is perpendicular to the front flat face 10D of the raised portion 14. It is to be noted that the sensor 20 is positioned at a predetermined distance "d" from the lower edge 12A of the door handle 12 under non-gripped condition. The key 18 is equipped with the magnet piece 22 of which the longitudinal axis is perpendicular to the longitudinal axis of the shank portion of the key. As is seen from FIG. 11, the magnet piece 22 is positioned at the distance "d" from the front edge 18E of the key head 18A, that is, the distance between the longitudinal axis of the magnet 22 and the front edge 18E is "d". Preferably, a slope 10E is formed between the bottom of the depression 10A and the front flat face 10D.

With this arrangement, it is very easy to bring the magnet-embedded portion of the key 18 close to the magnetic sensor 20. In fact, in order to lock the door from outside by using the magnet piece 22 in the key 18, the car owner (or driver) brings the key 18 to the depression 10A of the escutcheon 10 and orients it with its shank portion directed upward. Then, he or she contacts the front edge 18E of the key head 18A with the straight lower edge 12A of the door handle 12, and then slides the key 18 along the straight lower edge 12A toward the key cylinder 16. During this sliding, the key 18 assumes a position as shown in FIG. 11 where one pole (N or S) of the magnet 22 is very close to the sensor 20 thereby actuating the sensor 20. Thus, the door becomes locked. As may be understood from the above description, the arrangement proposed is very convenient especially when locking the door in the dark. If desired, in place of the door handle 12, a laterally extending raised portion formed on the escutcheon 10 may be used as the guide means for the key 18. Furthermore, when the present invention is applied to a vehicle having no escutcheon, such a raised portion may be formed on the outer panel of the door.

What is claimed is:

1. A magnetic locking system in combination with a door for locking said door to a fixed member comprising:

a key cylinder mounted in said door and adapted to be operatively associated with a door locking mechanism;

a magnetic sensor connected to said door in the vicinity of said key cylinder, said magnetic sensor being adapted to operate when a predetermined magnitude of magnetic force is applied thereto in a direction substantially parallel with a given axis of said magnetic sensor;

control means mounted to said door for locking said door to the fixed member when said magnetic sensor operates; and a magnet-mounted key means for engagement with said key cylinder to turn the same about its axis and having a key head and magnet piece fixed thereto, said magnet piece having at axially opposed end portions north and south poles, respectively, defining a polar axis and being adapted to apply said predetermined magnitude of magnetic force to actuate said sensor when positioned adjacent said magnetic sensor with the polar axis extending substantially parallel with said given axis of said magnetic sensor;

said magnet piece of said key means being arranged in said key head so that when the key means is operatively engaged with said key cylinder, the polar axis of said magnet piece describes a plane which intersects said given axis of said magnetic sensor as said key means turns the key cylinder about its axis.

2. A magnetic locking system as claimed in claim 1 in which said key cylinder and said magnetic sensor are connected to said door in such a manner that their axes are substantially perpendicular to said door, and said key means includes a shank extending longitudinally along an axis, said magnet piece being arranged on said key head such that said polar axis of the magnet piece is substantially perpendicular to said axis of the shank of said key means.

3. A magnetic locking system as claimed in claim 1 in which said key cylinder and said magentic sensor are mounted to an escutcheon fixed to said door.

4. A magnetic locking system as claimed in claim 3 in which said escutcheon receives therein a door handle which is adapted to engage a door latching mechanism mounted in said door, said door handle being linked to said door latching mechanism so that when the handle is moved, the latching mechanism unlatches the door from the fixed member.

5. A magnetic locking system as claimed in claim 4 in which said magnetic sensor is housed in a case which is tightly disposed in a recess formed in said escutcheon.

6. A magnetic locking system as claimed in claim 5, in which said case receives therein said control means.

7. A magnetic locking system as claimed in claim 6 in which said case is secured to said escutcheon by means of bolts.

8. A magnetic locking system as claimed in claim 1 in which said magnet-mounted key means comprises:

a key plate including a shank portion for engagement with said key cylinder, and an enlarged head portion:

a magnet piece having an opening, said shank portion of the key plate extending through said opening of that one side of said magnet piece is in contact with one side of said enlarged head portion of the key plate;

stopper means for tightly holding said magnet piece on said shank portion; and a molded plastic key head, the key head being molded on the key plate and covering said enlarged head portion, the magnet piece and said stopper means.

9. A magnetic locking system as claimed in claim 8 in which said shank portion has a longitudinal axis, and said magnet piece is connected to said key plate in such a manner that the polar axis thereof is substantially perpendicular to the longitudinal axis of said shank portion.

10. A magnetic locking system as claimed in claim 9 in which the enlarged head portion of said key plate is formed with recesses filled with the plastic of the key head thereby to assure bonding of the plastic key head to the key plate.

11. A magnetic locking system as claimed in claim 10 in which said stopper means comprises projections integrally formed on said shank portion of the key plate and engageable with the magnet piece.

12. A magnetic locking system as claimed in claim 10 in which said stopper means is a stopper plate which has an opening through which the shank portion of the key plate is snugly inserted and brought into contact with the magnet piece.

13. A magnetic locking system as claimed in claim 12 in which said stopper plate is formed with pawls at opposed sides of the opening thereof, the leading ends of the pawls being raised from a portion of said stopper plate so that upon assembly thereof on said shank portion, said stopper plate is in contact with one side of said magnet piece with the pawls resiliently engaged with said shank portion.

14. A magnetic locking system as claimed in claim 13 in which said stopper plate is snugly fixed in a shallow recess formed in said magnet piece.

* * * * *